US006702486B2

(12) United States Patent
Martin et al.

(10) Patent No.: US 6,702,486 B2
(45) Date of Patent: Mar. 9, 2004

(54) METHOD AND DEVICE FOR PROCESSING A COLOR REVERSAL PHOTOGRAPHIC FILM

(75) Inventors: Didier J. Martin, Givry (FR); Cécile A. Maudhuit, Harrow (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/207,613

(22) Filed: Jul. 29, 2002

(65) Prior Publication Data

US 2003/0044735 A1 Mar. 6, 2003

Related U.S. Application Data

(62) Division of application No. 09/788,748, filed on Feb. 20, 2001, now Pat. No. 6,451,518.

(30) Foreign Application Priority Data

Mar. 7, 2000 (FR) ..... 00 02881

(51) Int. Cl.[7] ..... G03D 3/02

(52) U.S. Cl. ..... 396/565; 396/626; 396/630

(58) Field of Search ..... 396/564, 565, 396/617, 620, 622, 626, 630; 430/379, 398, 407; 210/651, 652, 653

(56) References Cited

U.S. PATENT DOCUMENTS 5,372,918 A 12/1994 Usui et al.
5,607,592 A 3/1997 Bernard et al.
5,802,416 A * 9/1998 Earle et al. ..... 396/578
5,871,890 A 2/1999 Fitterman et al.
6,086,270 A * 7/2000 Earle et al. ..... 396/617

FOREIGN PATENT DOCUMENTS

EP 0 415 172 A2 3/1991
EP 0 908 766 A2 4/1999
FR 2 695 218 A 3/1994

* cited by examiner

*Primary Examiner*—Alan A. Mathews
(74) *Attorney, Agent, or Firm*—Chris P. Konkol

(57) ABSTRACT

The invention relates to a method and device for processing an exposed color reversal photographic film. This method enables the water consumption of the washing baths to be limited, the water levels being maintained by a counter-current coming from the bath placed downstream, an equivalent volume of water being discharged through an overflow. The wash waters are recovered and treated by a nanofiltration unit capable of giving a permeate which can be recycled to the washing baths. This method makes it possible to overcome the problem of the presence of tin (II) in the first washing bath supplied with water by a counter-current coming from the reversal bath. This process also makes it possible to overcome the problems of discharges of chemical substances to the drains while maintaining a good sensitometry of the developed films.

3 Claims, 1 Drawing Sheet

METHOD AND DEVICE FOR PROCESSING A COLOR REVERSAL PHOTOGRAPHIC FILM

CROSS-REFERENCE TO RELATED APPLICATION

This is a Divisional of application Ser. No. 09/788,748 filed Feb. 20, 2001, now U.S. Pat. No. 6,451,518.

FIELD OF THE INVENTION

The present invention concerns the processing of colour reversal photographic film with a low water consumption. More particularly, the invention concerns a method which enables the water consumption of washing baths to be limited, the water supply of the washing baths being maintained by a counter-current coming from the bath placed downstream, the excess volume of water being discharged through an overflow. The wash waters are recovered and purified by a single nanofiltration device capable of giving a permeate which can be recycled to the washing baths of the treatment. The method of the invention also makes it possible to overcome the problems of the discharge of chemical substances to the drains while maintaining good sensitometry of the developed films.

The invention also concerns a device for implementing the process.

BACKGROUND OF THE INVENTION

A conventional method for processing an exposed reversal colour film comprises successively a black and white development step, a chemical reversal step (or fogging exposure) and a color development step. The chemical reversal step or the fogging step makes it possible to develop the silver halides which had not been initially exposed. Such a processing for colour reversal films is well known and is described in detail in "Chimie et Physique Photographiques" volume 2, P. Glafkidès, 5th edition, Chapter XL, pages 947–967.

An example of such a processing method for a colour reversal film is the Ektachrome E-6® processing described in detail on page 954 of Glafkidès aforementioned book.

In the Ektachrome E-6® processing, the exposed photographic material passes successively through each of the following baths:

a) a black and white development bath,
b) a first washing bath,
c) a chemical reversal bath,
d) a color development bath,
e) a conditioning bath,
e) a bleaching bath,
f) a fixing bath,
g) one or more washing baths, and
h) a rinsing bath.

These are followed by a drying step.

When the photographic material passes from tank to tank, considerable quantities of chemicals are entrained from one tank to another either by the photographic material, or by conveyor belts which are used for moving the photographic material. These chemicals accumulate in the baths, reducing the efficiency thereof. Entrainment of these chemicals increases as the processing of photographic materials becomes more rapid.

The chemical contamination of the first washing bath comes from:

the 1st developer by entrainment of chemical substances, and the reversal bath, due to the maintenance of the water level of the first washing bath by a counter-current coming from the reversal bath.

The chemicals can be organic contaminants, such as the conventional constituents of black and white developers, for example metol, hydroquinone, phenidone, potassium hydroquinone monosulfate, 4-(hydroxymethyl)-4-methyl-1-phenyl-3-pyrazolidone (HMMP), or propionic acid. The chemicals can be inorganic contaminants, such as tin (II), coming from the reversal bath, as well as iron and halides.

In order to minimize the contamination of baths by these chemicals, it is known to use a regenerating solution. In practice, the regenerating solution is introduced into the contaminated bath to be regenerated and an equivalent volume of the exhausted bath is discharged through an overflow. This method generates a considerable volume of exhausted baths which can no longer be used photographically.

Another known method for minimizing the entrainment of chemicals consists of renewing the washing baths by adding thereto clean water continuously so as to maintain a very low concentration in chemicals in these washing baths. For example, it is known to place a first washing bath between the first black and white development bath and the chemical reversal bath. The purpose of this first washing bath is to interrupt the chemical reactions due to the first development bath and to prevent the migration by entrainment of the first developer to the reversal bath, preventing in this way a deterioration of the quality of the image of the developed film. Thus for a standard Ektachrome E-6® washing baths, a continuous supply of water which up to a flow rate of 7.5 liters per minute is currently used. This method therefore involves a large consumption of water, increasing in this way the cost of the processing. Moreover, development laboratories must now comply more and more with increasingly strict regulations which very closely limit the consumption of water per square meter of the developed films.

Similarly, in order to limit the consumption of water of mini-laboratories for the treatment of colour reversal photographic films, it is known to maintain the level of water in each washing bath by a counter-current coming from a bath downstream, and to discharge an equivalent volume of water into a reservoir by means of an overflow, while maintaining a supply of water for the final rinsing bath. This processing of exposed reversal colour films is used in mini-development laboratories (more commonly called a minilab) and comprises baths in the following order:

a) a black and white development bath,
b) a first washing bath, initially filled with clean water, of which the water level is maintained by a counter-current coming from the reversal bath and an equivalent volume of water is discharged by means of an overflow,
c) a chemical reversal bath,
d) a color development bath,
e) a conditioning bath,
f) a bleaching bath,
g) a fixing bath,
h) at least two final washing baths, the water level of which is maintained by a counter-current coming from a rinsing bath placed downstream, and
i) a final rinsing bath supplied with water from an auxiliary source. The drying step is then carried out.

However, one of the problems encountered by this type of installation is the accumulation with time of organic and inorganic contaminants in the baths, in particular in the washing baths. The washing baths cannot then be discharged to the drains and must be decontaminated first. Moreover, the accumulation of certain contaminants brings about harmful effects on the sensitometric quality of the development of the films. For example, when the tin (II) concentration is too high in the first washing bath, a very harmful effect is observed on the sensitometry of the developed films. In general, for this type of minilab, when a concentration of tin (II) is in excess of 400 ppm in the first washing bath, the sensitometry of the developed films is degraded. In order to overcome this problem, it has been proposed to use a flow of air bubbles so as to oxidize the tin (II) to tin (IV) which is less harmful for the sensitometry of the films to be developed. However, this type of technique brings about the formation of foam on the surface of the baths even when anti-foam agents are used. The formation of foam in processing baths should be avoided because it adds a source of contamination of the adjacent baths by overflow. Moreover, the accumulation of organic substances (black and white developers, co-developers etc) as well as the stream of air bubbles, favors the formation of biofilms in the first washing bath which can then contaminate the other baths of the processing by entrainment, either by the photographic material or by the belts conveying the photographic material. The formation of biofilms also causes a clogging of the cleaning filters of the tanks as well as the emission of nauseating odours. It is therefore necessary to perform frequent maintenance and cleaning operations involving numerous stoppages of the minilab.

Taking into account the above-mentioned problems, there is a need of systems for treating and recycling waters coming from the washing baths, as completely as possible, while keeping the level of chemical contaminants as low as possible in the washing baths and in particular in the first washing bath. It is particularly desirable for the tin (II) level to remain below 400 ppm in the first washing bath so as to maintain an acceptable quality of the sensitometry of the developed films.

SUMMARY OF THE INVENTION

One object of the present invention is to do away with the air bubbled through the first washing bath, and the formation of biofilms and foam.

Another object of the invention is to provide a method and a device for treating a colour reversal photographic film enabling a significant reduction to be made in the consumption of treatment water, as well as the volume of photographic effluents, and this without degrading the sensitometry of the developed films.

Another object of the invention is a photographic processing method which enables discharges of chemical substances to the drains to be reduced.

Still further objects will be apparent in a detailed manner in the following description.

BRIEF DESCRIPTION OF THE DRAWING

The drawing represents a diagrammatic view of a processing device for implementing the method of the invention.

DETAILED DESCRIPTION OF THE PREFERRED EMBODIMENT OF THE INVENTION

Figure 1:
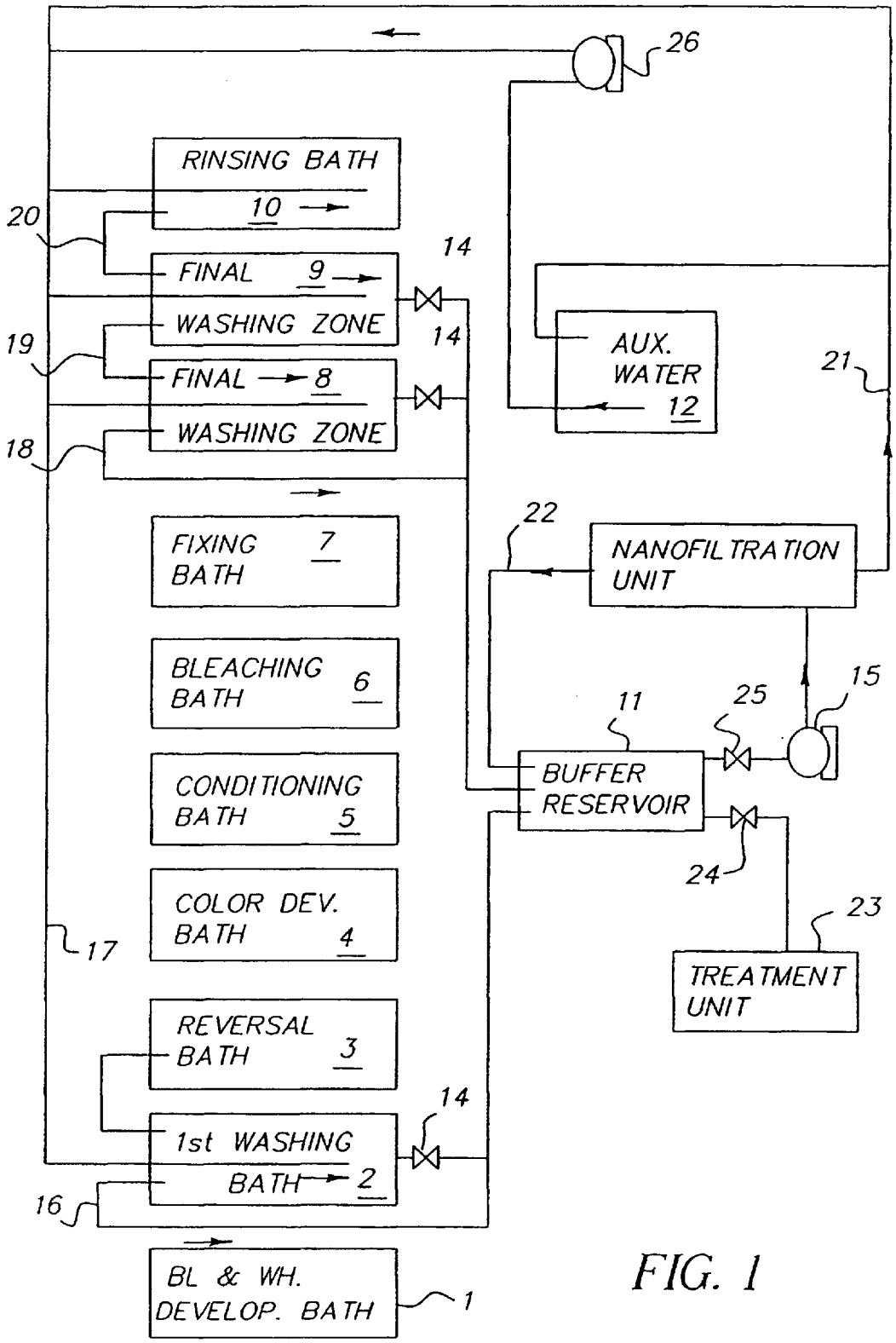

The method of the invention for the processing of an exposed colour reversal photographic film, comprises the steps of:

i) black and white developing the film;

ii) washing the film in a first washing bath;

iii) chemical fogging the films in a reversal bath containing tin (II) salts;

iv) color developing the film, and the water level in the first washing bath is maintained by a counter-current coming from the reversal bath, a volume of water at least equal to that provided by the counter-current being discharged through an overflow. additionally includes the collection of waters coming from said overflow and from the contents of said first washing bath which are passed through a nanofiltration device to give a permeate which can be used photographically.

According to one embodiment, the permeate is recycled to the first washing bath and the method comprises the following steps:

a) the exposed film is successively circulated in:
   i) a black and white development bath
   ii) a first washing bath, the water level of which is maintained by a counter-current coming from a reversal bath, a volume of water at least equal to that provided by the counter-current being discharged, for example into a buffer reservoir,
   iii) a reversal bath containing tin-II salts,
   iv) a chromogenic development bath,
   v) a bleaching bath,
   vi) a fixing bath,
   vii) a rinsing bath, b) the exposed film is passed through a final washing zone which comprises at least two washing baths placed in sequence, the water levels of which are maintained by a counter-current coming from the rinsing bath placed downstream from the baths of the final washing zone, a volume of water at least equal to that provided by the counter-current being discharged through an overflow into a buffer reservoir, c) the water from the washing baths is collected (e.g. by means of an overflow and/or by emptying the washing baths) in a buffer reservoir and this water can be passed through a nanofiltration device common to all the baths, and d) the permeate coming from the said nanofiltration device can be recycled either to an auxiliary source for supplying the washing baths with water or directly to one or more washing baths of said process.

According to another embodiment, the invention, a colour reversal photographic processing device is provided, which comprises:

a) i) a black and white development unit,
   ii) a first washing unit of which the water level is maintained by a counter-current coming from the reversal unit, a volume at least equal to that provided by the counter-current being discharged into a buffer reservoir,
   iii) a reversal unit containing a reversal bath with tin-II salts,
   iv) a color development unit,
   v) a bleaching unit,
   vi) a fixing unit, and
   vii) a final washing zone,
   viii) a rinsing unit b) a buffer unit enabling the water from the washing baths to be collected (through an overflow and/or by emptying the washing baths), c) a nanofiltration unit common to all the baths, and intended to receive and treat the water coming from said buffer reservoir and/or the washing baths, d) a unit for recycling the permeate coming from said nanofiltration unit directly to an auxiliary source for supplying said process and/or one or more washing baths with water, e) a unit for recycling the retentate coming from said nanofiltration unit to the buffer unit.

Advantageously, the final washing zone of said installation consists of two or more washing baths placed in sequence, of which the water levels are maintained by a counter-current coming from the rinsing bath placed downstream from the washing zone.

According to another variant of the device, a tank is provided for receiving the retentate coming from the nanofiltraton unit.

The nanofiltraton unit used according to the invention uses membranes for the separation of dissolved substances or chemical products from dilute solutions. Nanofiltration is a technique used for the selective separation of salts and organic compounds in solution. The membranes used for nanofiltration thus act like sieves having a large surface area with pores of microscopic or molecular sizes of which the dimensions must be very regular so that the molecules of a particular size are retained while smaller molecules or ions of simple salts pass through the membrane. The membranes for nanofiltration generally allow molecules to pass having a molecular weight of between 200 and 1000 dalton. Multivalent ionized salts and the non-ionized organic compounds with a molecular mass greater than a 1000 dalton are, on the other hand, strongly retained.

A membrane is generally defined by its cut-off threshold which is the molecular weight of the smallest chemical entity retained by the membrane for a retention value equal to 0.9.

The retention value (RV) for a membrane is defined by the equation:

$$RV=1-(C_p/C_r)$$

where $C_r$ is the concentration of the species to be retained in the retentate and $C_p$ is the concentration of the same species in the permeate.

The solution which has passed through the membrane is called the filtrate or permeate and the solution which is retained by the membrane is called the concentrate or retentate. A permeate is said to be photographically useful when it can be reused for the readjustment of one of the treatment baths. The permeate is thus recyclable by a suitable loop, or optionally it may be discharged to the drains, provided it does not contain substances harmful for the environment.

The nanofiltration membranes may be inorganic or organic. Organic membranes are membranes based on cellulose acetate, poly(amide/imide), polysulfone, acrylic polymers or fluorine-containing polymers. Inorganic membranes are membranes based on carbon, ceramics, anodized aluminium, sintered metal or porous glass or are even made of a woven composite based on carbon fibre. The nanofiltration membranes are selected to be capable of retaining contaminants contained in the washing baths. According to an embodiment, the nanofiltration unit can have advantageously, a retention value for tin (II) of at least 0.9. The flow and the applied pressure will be chosen in a suitable manner in order to maintain such a retention value. Preferably, the applied pressure will vary between 5 and 40 bar and preferably between 10 and 20 bar. According to a particular embodiment, the nanofiltraton membrane is either the FILMTEC® NF45 membrane, or the FILMTEC® NF70 membrane marketed by Dow Europe Separation Systems® or the Osmonics DK® membrane or the Osmonics MX® membrane or the Osmonics SV® membrane marketed by the Osmonics company. It has been observed that, the preferred nanofiltration membranes which can be used according to the invention have a wetting angle of between 30° and 90° and preferably between 35° and 77°. Preferably, the membrane useful in the method of the invention will have a cut-off threshold of between 100 and 1000 dalton and preferably between 150 and 500 dalton.

In the following description, reference will be made to the drawing which represents, in a diagrammatic manner, an embodiment of the device for implementing the method of the invention. As illustrated, the film to be developed is conveyed to a black and white development bath (1) on leaving which the film passes into a first washing bath (2), which, when the processing starts, is filled with clean water and of which the water level is maintained by a counter-current (17) coming from the reversal bath (3). In order to prevent the tank of the first washing bath from overflowing and in order to enable its waste waters to be recycled, an overflow device (16) enables the waste waters to be discharged to a buffer reservoir (11). The film is then conveyed to the reversal bath (3), containing tin (II). It then passes successively into a color development bath (4), a conditioning bath (5), a bleaching bath (6), a fixing bath (7), a final washing zone composed of baths (8) and (9) and finally a rinsing bath (10). The levels of the washing baths (8) and (9) are maintained by the counter-currents (19) and (20) respectively. The rinsing bath (10) contains conventional additives such as surfactants as in the final bath of the Ektachrome E-6® processing. According to a feature of the present invention, clean water may be added to the baths (2), (8), (9) and (10) coming from an auxiliary source (12) via a pump (26). A commonly accepted definition of the concept of clean water is given by way of indication in Photographic Science and Engineering, volume 9, No.6, November–December 1965, pages 398–413. The waste waters from the washing baths (2), (8) and (9) may be discharged to the buffer reservoir (11) either via overflows (16) and (18), or via emptying valves (14). The waste waters are conveyed from the buffer reservoir (11) through a nanofiltration unit (13) with a membrane by opening the valve (25) and with the aid of a high-pressure pump (15). The retentate (22) coming from the nanofiltration unit (13) may be either discharged, or recycled to the buffer reservoir (11). The concentration of the solution in the buffer reservoir (11), can be measured by conductivity so that its contents is discharged to an auxiliary treatment unit (23) in order to be treated when its concentration reaches or exceeds a certain value. As an example, a valve (24) may be provided so as to enable this discharge to be carried out. The permeate (21) may supply clean water directly either to an auxiliary source (12) or the final washing zone, or the first washing bath, or the rinsing bath (10). The auxiliary source of water (12) may serve either to renew the washing baths (2), (8) and (9) after they have been emptied and circulated though the nanofiltration device, or to supply water to the baths (2), (8), (9) and/or (10). This embodiment is particularly advantageous since it makes possible, as the following examples show:

- a reduction in the water consumption of the minilab by a factor of at least 50,
- greater stability of the baths used in the processing,
- a reduction in the time required for maintenance of the minilab (cleaning etc),
- a reduction in the volume of water used by the minilab (97–98% of water is recycled),
- treatment in one operation of the washing solutions having various chemical contaminants,
- limitation of the formation of biofilms in the first washing bath, and
- elimination of the operation of bubbling air into the first washing bath.

The invention is further described in detail in the following examples.

EXAMPLES

Example 1 (Comparative)

Variation of Dmax as a Function of the $Sn^{2+}$ Concentration

A Noritsu QSF-R4103 E6 minilab, was used while varying the concentration of $Sn^{2+}$ in the first washing bath. Exposed professional Ektachrome 64 (EKT-64) and Kodak Ektachrome 100 (EKT-100) films were processed in this minilab in accordance with the Ektachrome E-6® processing.

This minilab used the following sequence:

| E-6 baths | Duration | Temperature ° C. | Maintenance rate ml/m² |
|---|---|---|---|
| 1st development (1) | 6 min | 38 | 2150 |
| 1st wash (2) | 2 min 30 s | 37–38 | counter-current |
| Reversal bath (3) | 2 min 30 s | 38 | 1075 |
| Chromogenic development (4) | 6 min | 38 | 2150 |
| Conditioner (5) | 2 min 30 s | 38 | 1075 |
| Bleaching (6) | 6 min | 40 | 230 |
| Fixing (7) | 2 min 30 s | 38 | 1075 |
| Final wash (8) | 2 min 30 s | 37–38 | counter-current |
| Final wash (9) | 2 min 30 s | 37–38 | counter-current |
| Rinsing (10) | 2 min 30 s | 30–34 | 2150 |

The water level in the first washing bath (2) as well as that of the washing baths (8) and (9) were maintained by a counter-current coming from the bath situated downstream. No air was bubbled into the first washing bath. The final rinsing bath (10) contained the conventional additives of a rinsing of the Ektachrome E-6® process. The procedure was then pursued in a conventional manner by carrying out a drying operation (temperature>67° C.).

Measurements of Dmax are given in Table 1.

TABLE 1

Measurement of Dmax as a function of the concentration of $Sn^{2+}$ in the first washing bath

| | | $[Sn^{2+}]$ g/l | 0 | 0.4 | 0.7 | 0.9 | 1.2 |
|---|---|---|---|---|---|---|---|
| EKT-64 | Dmax | Red | 2.80 | 2.82 | 2.77 | 2.78 | 2.75 |
| | | Green | 2.78 | 2.80 | 2.74 | 2.74 | 2.76 |
| | | Blue | 2.98 | 2.96 | 2.90 | 2.91 | 2.87 |
| EKT-100 | Dmax | Red | 3.20 | 3.16 | 3.09 | 3.09 | 3.11 |
| | | Green | 3.50 | 3.51 | 3.18 | 3.23 | 3.19 |
| | | Blue | 3.66 | 3.64 | 3.54 | 3.60 | 3.58 |

It was noted that Dmax was affected by the $Sn^{2+}$ concentration and that it was desirable to maintain this concentration at a level below 0.4 g/l in order to obtain an acceptable sensitometry.

Example 2 (Invention)

A minilab with the sequence described in example 1 was used. The baths of the minilab were seasoned with the aid of EKTACHROME format 135 (36 exposures) films of the Kodak Elitechrome 100 (EK100) type (10 films for experiment 2-a and 20 films for experiment 2-b).

Then, the water coming from the first washing bath (2) and from the washing bath (8) during development, is collected in a buffer reservoir by means of an overflow.

The water coming from the washing baths (2), (8) and (9) is also collected in the buffer reservoir by emptying.

The water coming from this buffer reservoir (11) was circulated through an NF45 FILMTEC (DOW) filtration membrane with a feed rate of 500 l/h for a pressure of 10 bar. The volume of effluents circulated through the membrane was between 10 and 20 liters, and the filtration was carried out during between 8 and 16 minutes. The recycling rate of the water collected was 97–98%. The permeate was collected in a tank serving as an auxiliary source and was reintroduced into the machine in the washing baths 2, 8 and 9 after adjusting the pH to 7 and the calcium level (50 mg/l) with the aid of calcium chloride.

The quality of the treatment was followed by control sensitograms, catalogued under the name "Kodak Control Strips, Process E-6 (emulsion 8111)" provided by the KODAK company. These sensitograms, which were pre-exposed, were developed after seasoning with 10 EK100 films (experiment 2-a) and 20 EK100 films (experiment 2-b). The densities of the red, green and blue colours were then measured with a densitometer at different exposures in order to determine the level of the quality of the development process.

The following densities were measured

- the maximum density (Dmax) which corresponded to the density of an unexposed zone,
- the minimum density (Dmin) which is represented by the density of an exposure greater than 1.6 Log E at an exposure giving a density of 0.8,
- the high density (HD) useful for evaluating the colour,
- the low density (LD) useful for evaluating speed.

The control sensitogram measurements were then compared with a reference, representing the optimum operating characteristics for an Ektachrome E-6® treatment, and the deviation measured for each density of each colour was tabled.

These sensitograms were used in accordance with the manual "Process E-6 using Kodak chemicals" chapter 13. n°Z-119 published by Kodak (October 1997).

The results are given in table 2.

Example 3 (Comparative)

A minilab according to the sequence described in example 1 was used. The first washing bath was aerated with air bubbles at a rate of 0.5 l/min so as to limit the concentration of tin (II).

The baths of the minilab were seasoned by developing EKTACHROME format 135 (36 exposures) films of the Kodak Elitechrome 100 (EK100) type (10 films for experiment 3-a and 20 films for experiment 3-b). The quality of the processing was followed as in example 2. The results are given in table 2.

TABLE 2

Results of examples 2 and 3

| Examples | Water Consumption per m² of developed film | | Dmax | HID | LD | Dmin |
|---|---|---|---|---|---|---|
| 2-a (invention) | 0.16 l/m² | red | 0.15 | 0.05 | 0.02 | 0.02 |
| | | green | 0.11 | 0.05 | 0.04 | 0.01 |
| | | blue | 0.1 | 0.02 | 0.03 | 0.01 |
| | | Vmax | 0.05 | 0.03 | 0.02 | 0.01 |

TABLE 2-continued

Results of examples 2 and 3

| Examples | Water Consumption per $m^2$ of developed film | | Dmax | HID | LD | Dmin |
|---|---|---|---|---|---|---|
| 2-b (invention) | 0.16 $l/m^2$ | red | 0.17 | 0.06 | 0.01 | 0.01 |
| | | green | 0.13 | 0.07 | 0.05 | 0.01 |
| | | blue | 0.12 | 0.02 | 0.02 | 0.01 |
| | | Vmax | 0.05 | 0.05 | 0.04 | 0 |
| 3-a (comparative) | 9.2 $l/m^2$ | red | 0.21 | 0.09 | 0.03 | 0.02 |
| | | green | 0.07 | 0.07 | 0.04 | 0.01 |
| | | blue | −0.13 | −0.13 | −0.04 | 0 |
| | | Vmax | 0.27 | 0.22 | 0.08 | 0.02 |
| 3-b (comparative) | 6.2 $l/m^2$ | red | 0.16 | 0.04 | 0.01 | 0.02 |
| | | green | 0.12 | 0.06 | 0.04 | 0.01 |
| | | blue | −0.15 | −0.17 | −0.09 | −0.01 |
| | | Vmax | 0.31 | 0.23 | 0.13 | 0.03 |

The maximum variations (Vmax) represent the difference of the maximum density between the measurements of the three colours. Vmax thus represents the dispersion recorded for each parameter in the three colours. It is therefore desirable to obtain a very low value for Vmax so as to maintain the balance of each characteristic for the three colours. The acceptable recommended limits for Vmax with an E-6 treatment are as follows:

for LD (speed), Vmax<0.07, for HD (colour), Vmax<0.11.

It will be clearly seen that the invention complies with these conditions whereas the comparative tests are outside the recommended limits. Consequently, the process according to the invention makes it possible to maintain good sensitometric quality of the developed films.

The invention consumes much less water than the comparison for the same area of developed films.

Moreover, the first washing bath according to the invention does not have any foam on the surface or biofilms, thus preventing any risk of contamination of adjacent baths, which is different from the first washing bath of the comparative device which exhibited the formation of foam on the surface.

Example 4

The minilab was used according to the configuration described in example 1. The baths of the minilab were seasoned by developing EKTACHROME format 135 (36 exposures) films of the Kodak Elitechrome 100 type at the rate of 10 films per day. The device was kept in operation for 20 days. The following was collected in a buffer reservoir:

by means of an overflow, the water coming from the first washing bath (2) and the washing bath (8) during operation of the minilab, and by emptying, the water coming from the washing baths (2), (8) and (9).

The water coming from this buffer reservoir was treated daily with the aid of an NF45 FILMTEC (DOW) filtration membrane with a feed rate of 500 l/h under a pressure of 20 bar. The volume of effluents treated was between 10 and 20 liters, and the treatment time was between 8 and 16 minutes. The recycling rate of the water collected was 97–98%. The permeate was collected in a bath acting as an auxiliary source and was reintroduced into the machine, in the washing baths 2, 8 and 9, after adjusting the pH to 7 and the calcium level (50 mg/l) with the aid of calcium chloride. Measurements were taken each day of the concentration of chemical contaminants in the permeate (Table 3) and the $Sn^{2+}$ concentration in the first washing bath (2) (Table 4) by capillary zone electrophoretic (CZE) and Plasma emission spectrometry (ICP-AES) techniques, the concentration of organic contaminants in the different washing baths (Table 5) by the high pressure liquid chromatography technique (HPLC) and the tin concentration by colorimetric titration.

The initial concentration of chemical contaminants in the buffer reservoir was:

Total Sn: 47 ppm

Fe: 1.1 ppm

Ag: 5.1 ppm

Thiocyanate: 2 ppm

Sulfate: 60 ppm

Thiosulfate: 102 ppm.

TABLE 3

Concentrations (in ppm) of chemical contaminants in the permeate

| Day | Total Sn | Fe | Ag | Thiocyanate | Sulfate | Thiosulfate |
|---|---|---|---|---|---|---|
| 1 | 0.13 | 0.05 | 0.40 | 2 | 10 | 15 |
| 2 | 0.13 | 0.03 | 0.08 | 4 | 6 | 16 |
| 3 | 0.18 | 0.02 | 0.06 | 6 | 7 | 18 |
| 4 | 0.20 | 0.00 | 0.00 | 7 | 8 | 23 |
| 5 | 0.30 | 0.00 | 0.00 | 8 | 13 | 35 |
| 6 | 0.20 | 0.10 | 0.10 | 11 | 11 | 40 |
| 7 | 0.30 | 0.11 | 0.20 | 12 | 13 | 60 |
| 8 | 0.50 | 0.08 | 0.13 | 12 | 11 | 58 |
| 9 | 0.50 | 0.09 | 0.11 | 15 | 9 | 48 |
| 10 | 0.11 | 0.09 | 0.14 | 14 | 8 | 34 |
| 11 | 0.22 | 0.10 | 0.20 | 15 | 7 | 39 |
| 12 | 0.13 | 0.10 | 0.03 | 14 | 8 | 40 |
| 13 | 0.30 | 0.10 | 0.10 | 15 | 8 | 52 |
| 14 | 0.30 | 0.10 | 0.08 | 16 | 8 | 48 |
| 15 | 0.20 | 0.05 | 0.05 | 15 | 6 | 38 |
| 16 | 0.24 | 0.07 | 0.05 | 12 | 3 | 11 |
| 17 | 0.24 | 0.09 | 0.05 | 10 | 5 | 14 |
| 18 | 0.17 | 0.15 | 0.04 | 9 | 5 | 17 |
| 19 | 0.26 | 0.07 | 0.01 | 10 | 7 | 19 |
| 20 | 0.20 | 0.08 | 0.03 | 8 | 7 | 22 |

TABLE 4

Concentration of $Sn^{2+}$ (g/l) in the first washing bath

| Day | $[Sn^{2+}]$ (g/l) |
|---|---|
| 1 | 0.12 |
| 2 | 0.30 |
| 3 | 0.28 |
| 4 | 0.18 |
| 5 | 0.25 |
| 6 | 0.20 |
| 7 | 0.35 |
| 8 | 0.25 |
| 9 | 0.12 |
| 10 | 0.15 |
| 11 | 0.18 |
| 12 | 0.18 |
| 13 | 0.18 |
| 14 | 0.15 |
| 15 | 0.20 |
| 16 | 0.18 |
| 17 | 0.18 |
| 18 | 0.20 |
| 19 | 0.20 |
| 20 | 0.18 |

TABLE 5

Concentration of organic contaminants in the different washing baths after 20 days:

| Washing bath | DCO mg/l | TOC mg/l | KHQS mg/l | HMMP mg/l |
|---|---|---|---|---|
| 1st washing bath (2) | 18349 | 4900 | 265 | 23.7 |
| Final wash (8) | 465 | 157 | 5 | 0 |
| Final wash (9) | 278 | 137 | 0 | 0 |
| Rinsing (10) | 1211 | 525 | 0 | 0 |

TOC: Total organic carbon
KHQS: Potassium hydroquinone monosulfonate
HMMP: 4-(hydroxymethyl)-4-methyl-1-phenyl-3-pyrazolidone From table 3, it can be seen that the permeate was very weakly loaded with chemical compounds, demonstrating in this way the efficiency of the method according to the invention. In addition, from table 4, it can be clearly seen that the concentration of $Sn^{2+}$ was maintained below 0.4 g/l which avoided the use of an air bubbling system in the first washing bath. For Table 5, it can be seen that the concentrations of developer (KHQS) and co-developer (HMMP) were maintained at low concentrations in the final washing baths. This clearly shows that the nanofiltration unit was effective for the elimination of organic compounds.

Europe Separation Systems, and Osmonics DK® (DK), Osmonics BQ® (BQ), Osmonics MX® (MX) and Osmonics SV® (SV) marketed by the Osmonics company. An Osmonics GH® (GH) membrane was also studied, used for ultrafiltration techniques, as a comparison.

The wetting angles were obtained by the Wilhemy blade method which is based on the force necessary to pull a thin plate of a specimen from a liquid, this plate being suspended from one of the arms of a balance and immersed in this liquid. The liquid is kept at 24° C. The surface tension $\gamma$ of the liquid is first of all measured by means of a strip of filter paper for which $\theta=0$. The wetting angle is defined by the following formula:

$$\cos\theta=\Delta W/Pe.\gamma$$

where $\Delta W$ is the variation of the weight of the plate at the moment it contacts the liquid, and Pe is the perimeter of the plate.

The hydrophobic character increases with the value of the wetting angle.

The performances of these membranes are given together in Table 6 below.

TABLE 6

Degree of retention measured for different membranes

| | Membranes | | | | | |
|---|---|---|---|---|---|---|
| | NF-45 | DK | BQ | MX | SV | GH |
| Type | NF | NF | NF | NF | NF | UF |
| Cut-off treshold (dalton) | 200 | 150–300 | 200–300 | 300–500 | 300–500 | 2500 |
| θ (°) | 46.3 | 67.2 | 94 | 57.3 | 77.2 | 67.8 |
| DR Ag | 0.99 | 0.99 | 0.99 | 0.97 | 0.99 | 0.99 |
| DR $Sn^{2+}$ | 0.99 | 0.99 | 0.83 | 0.99 | 0.99 | 0.98 |
| DR Fe | 0.97 | 0.95 | 0.83 | 0.85 | 0.99 | 0.86 |
| DR Ca | 0.99 | 0.99 | 0.80 | 0.99 | 0.99 | 0.96 |
| DR $S_2O_3$ | 0.98 | 0.98 | 0.35 | 0.98 | 0.98 | 0.58 |
| DR TOC | 0.63 | 0.79 | 0.27 | 0.91 | 0.75 | 0.35 |

NF = nanofiltration
UF = ultrafiltration
DR = degree of retention
TOC = total organic carbon

Example 5

The minilab was used according to the configuration described in example 1. The baths of the minilab were seasoned by developing EKTACHROME format 135 (36 exposures) films of the Kodak Elitechrome 100 (EK100) type (10 films). In this example, the waste water from the buffer reservoir (11) consisted of the waters collected through the overflows of the washing baths (2) and (8) during development as well as those obtained by emptying the washing baths (2), (8) and (9). These waters were treated through a 400 ml Berghof® nanofiltration unit, sold by Prolabo and fitted with a 32 $cm^2$ nanofiltration membrane. The unit was fitted with a magnetic stirrer.

250 ml of the waste waters coming from this buffer reservoir were introduced into the 250 ml cell. After closing the cell, nitrogen was introduced therein so as to obtain a pressure giving a permeate flow of between 15 and 55 $\mu m^2$ per hour.

Nanofiltration was carried out by means of the following membranes: FILMTEC NF45® (NF45), marketed by Dow For membranes of the nanofiltration type, it can be seen that the most efficient membranes are those which have a wetting angle below 90°. For example, the BQ membrane which has a wetting angle of 94° is less efficient for eliminating thiosulfates and organic compounds. Moreover, it can be clearly seen that with the GH membrane, which is a membrane for ultrafiltration having a cut-off threshold very much higher than that of nanofiltration membranes (100 to 1000 dalton), there is a loss of efficiency for the elimination of thiosulfates or organic compounds.

Consequently, the method according to the invention is useful for developing colour reversal photographic films with a low water consumption, and more particularly in the case of minilabs for developing colour reversal photographic films.

The invention has been described in detail with particular reference to certain preferred embodiments thereof, but it will be understood that variations and modifications can be effected within the spirit and scope of the invention.

What we claim:

1. A color reversal photographic processing device comprising:

a) i) a black and white development unit, ii) a first washing unit of which the water level is maintained by a counter-current coming from a reversal unit containing tin (II) salts, a volume of water at least equal to that provided by the counter-current being discharged through an overflow, iii) said reversal unit containing tin (II) salts, iv) a color developing unit, v) a final washing zone, vi) a rinsing unit, b) a nanofiltration unit capable of receiving and treating the water coming from the first washing unit and the final washing zone, c) a unit for recycling of the permeate coming from the said nanofiltration unit to the first washing and/or the final washing zone and/or the rinsing unit.

2. The color reversal photographic processing device of claim 1, wherein the final washing zone comprises two or more washing units placed in sequence, of which the water levels are maintained by a counter-current coming from the rinsing unit placed downstream, a volume of water at least equal to that provided by the counter-current being discharged through an overflow.

3. The color reversal photographic processing device of claim 2, additionally including a buffer reservoir for collecting the water overflows and/or the liquid emptied from the washing units, and for recirculating these overflows and/or the liquid from this emptying to said nanofiltration unit.

* * * * *